United States Patent [19]

Pfeifer

[11] 4,215,789

[45] Aug. 5, 1980

[54] BASKET WITH SELF-LOCKING HANDLE

[75] Inventor: William Pfeifer, Springdale, Pa.

[73] Assignee: Armstrong Store Fixture Corporation, Pittsburgh, Pa.

[21] Appl. No.: 48,844

[22] Filed: Jun. 15, 1979

[51] Int. Cl.[2] ..... B65D 25/28; B65D 25/32

[52] U.S. Cl. ..... 220/96; 220/91; 220/95

[58] Field of Search ..... 220/91, 94 R, 95, 96

[56] References Cited

U.S. PATENT DOCUMENTS

| | | | |
|---|---|---|---|
| 935,177 | 9/1909 | Walker | 220/96 |
| 1,512,163 | 10/1924 | Duckett | 220/96 |
| 3,419,196 | 12/1968 | Moore | 220/95 |
| 3,756,451 | 9/1973 | Popeil | 220/94 R |

FOREIGN PATENT DOCUMENTS

| | | | |
|---|---|---|---|
| 1166967 | 11/1958 | France | 220/96 |

*Primary Examiner*—George E. Lowrance

*Attorney, Agent, or Firm*—Parmelee, Miller, Welsh & Kratz

[57] ABSTRACT

A merchandise basket is provided with a U-shaped handle with a pair of legs straddling the sides of the basket and terminating in opposed, inwardly directed feet. Necked portions of the feet slidably and rotatably engage slots in the side walls of the basket. With the feet at the bottom of the slots, the handle is freely rotatable; but when the handle is lifted while in the vertical position, the sides of the feet engage notches in a flange which depends from an outwardly directed rim on the basket to preclude rotation of the handle.

3 Claims, 3 Drawing Figures

BASKET WITH SELF-LOCKING HANDLE

BACKGROUND OF THE INVENTION

1. Field of the Invention

This invention relates to a basket and handle combination in which the handle is locked in the vertical position when raised and automatically rotates to a generally horizontal stowed positioned when released.

2. Prior Art

It is common practice to provide customers of self-service retail stores with hand-held baskets for carrying small pieces of merchandise. Generally, these baskets are elongated and provided with free swiveling U-shaped handles which straddle the basket and are pivotally connected to the midpoints of the long sides of the baskets. The handles of such baskets pivot when released to a stowed position which facilitates stacking of the baskets. However, with these free swiveling handles, there is a tendency for the basket to tip and possibly spill the contents if a heavy object is placed in one end of the basket or the load shifts while the basket is being carried by the handle.

Some attempts have been made to provide a handle on these merchandise baskets which can easily be rotated to a stowed position but which can be locked in a vertical position when raised. Accordingly, wire baskets have been made in which loops at the ends of the legs of the wire handles slide upward in slots in the sides of the baskets when the handle is lifted to engage a recess either in the wire forming the top edge of the basket or in a metal plate welded to the top edge wire. A plastic basket has also been produced in which each leg of the handle is inserted between two spaced upwardly directed planar members on the side of the basket. A necked outward projection on the outside of the leg slides vertically and rotates in a vertical slot in the outer member, while an inward projection on the end of the leg engages a groove in the inside member when the handle is raised.

SUMMARY OF THE INVENTION

According to the invention, the top edge of a merchandise basket is provided with a laterally outwardly extending rim which terminates in a downwardly directed flange spaced from the side of the basket. A vertical closed-end slot in each side wall of the basket is horizontally aligned with a vertical notch extending upward from the lower edge of the opposed flange. A U-shaped handle having two legs depending from a hand grasping base portion straddles the sides of the basket. Opposed feet project inwardly toward each other from the free ends of the handle legs, and necks on these feet are slidably and rotatably received in the vertical slots in the side walls of the basket so that the handle can be rotated between a stowed, generally horizontal position to a vertical position. When the handle is lifted while in the vertical position, the sides of the feet engage the vertical notches in the flanges to prevent the handle from rotating and thereby prevent tipping of the basket; yet, when the basket is placed on a planar surface and the handle is released, the handle will fall to the bottom of the slot and rotate to the stowed position under the influence of gravity.

Preferably, the slots in the side walls of the basket and the notches in the flanges are dimensioned such that the load is distributed between the side wall and the flange. It is also desirable to provide walls extending transversely between the basket side walls and the flanges on either side of the notches in the flanges to provide rigidity.

DESCRIPTION OF THE PREFERRED EMBODIMENT

Figure 1:
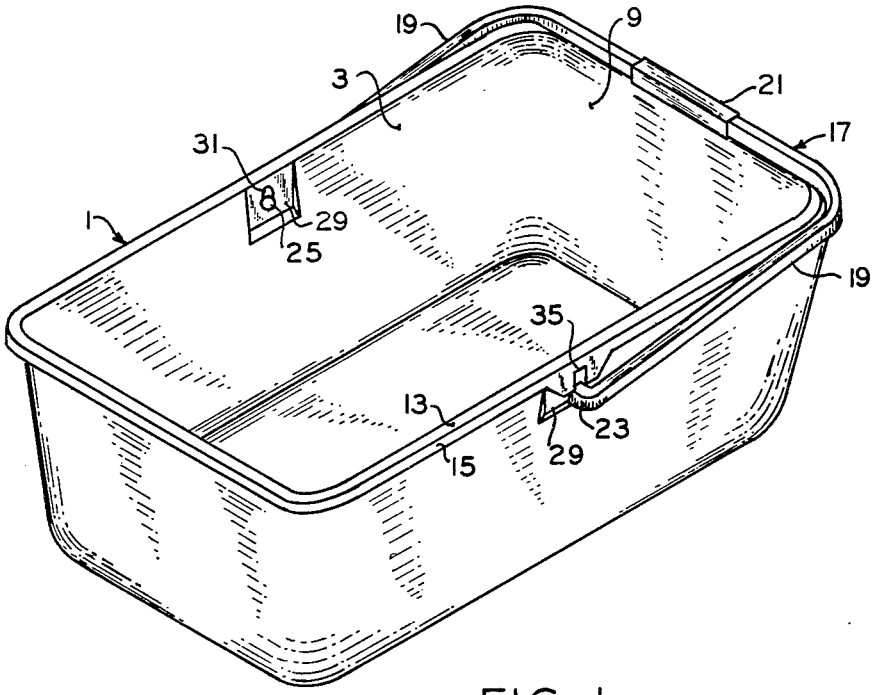
FIG. 1 is an isometric view of a merchandise basket incorporating the invention and showing the handle in the stowed position.

FIG. 1 illustrates an open topped merchandise basket 1 having side walls 3 and 5, end walls 7 and 9 and a bottom 11. The walls, and even the bottom of the basket if desired, may be of open lattice construction of any configuration suitable for weight reduction and aesthetic appearance. In addition, the walls may taper outward slightly to facilitate stacking of the baskets. A rim 13 extends laterally outward from the upper edges of the side and end walls of the basket and terminates in a downwardly directed flange 15 spaced from the walls.

A U-shaped handle 17 having two legs 19 depending from a base portion 21 with a molded handgrip straddles the basket and is rotatably connected to the midpoints of the side walls 3 and 5 in a manner to be discussed below. The free ends of the legs 19 curve inward to form opposed feet 23 which terminate in a circular button 25 spaced from the foot by a necked portion 27. The neck portion may be circular, star shaped as illustrated, or any other suitable shape.

Figure 2:
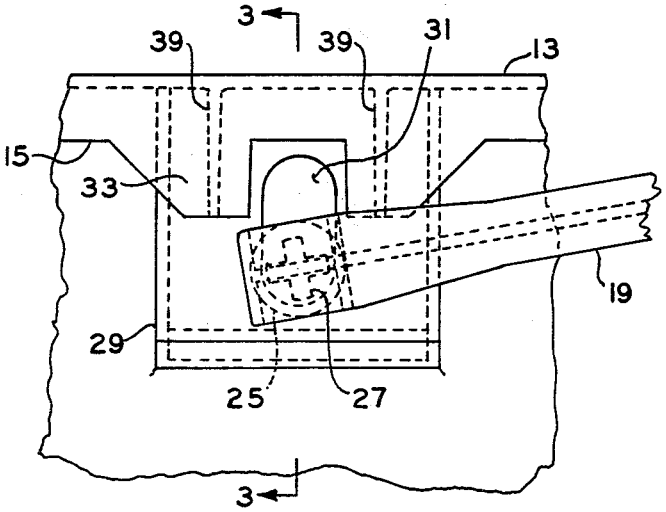
FIG. 2 is a side elevation view of a portion of the basket of FIG. 1 illustrating the means for attaching the handle thereto and showing the handle in the stowed position.
Figure 3:
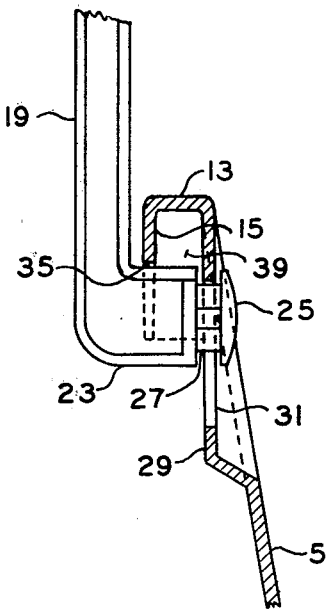
FIG. 3 is a vertical section taken along the line III—III in FIG. 2, showing the handle in the raised position.

As seen in FIGS. 2 and 3, the side walls are provided at their midpoints with a vertical planar section 29 in which there is an elongated, closed-end vertical slot 31. Opposite the slot 31, the flange 15 is extended downward as at 33 and is provided with a vertical notch 35 extending upward from the downwardly directed free edge 37 of the flange. Transverse walls 39 on either side of the notch 35 connect the flange to the side wall for rigidity.

The handle 13 is connected to the basket with the legs straddling the side walls and the necked portions 27 of the feet 23 slidably engaged in the slots 31 in the side walls 3 and 5 with the buttons 25 on the inside of the basket. With the necked portions 27 of the feet located at the bottom of the slots 31, the handle is freely rotatable from the nearly horizontal stowed position where it rests on top of one end of the basket as shown in FIG. 1 to a vertical position. When the handle is lifted while in the vertical position, the necked portions 27 of the feet will slide upward in the slots 31 and the sides of the feet 23 will slide into the notches 25 in the flange to preclude rotation of the handle. Thus, as long as upward pressure is maintained on the handle, the handle will be locked in the vertical position so that the tendency of the basket to tip if a heavy object is placed in one end or the load shifts can be resisted by the person carrying the basket. When the basket is set down and the handle is released, the necked portions 27 of the feet will slide to the bottom of slots 31 and the handle will fall to the stowed position under the influence of gravity. If desired, the fit of the necked portions 27 of the feet 23 in slots 31 or of the sides of the feet 23 in notches 35, can be made snug enough that a positive force will be required to lower the handle. Preferably, the dimensions of the slots 31, notches 35 and the feet 23 and their necked portions 27 are such that with the handle raised, the neck portions 27 engage the tops of slots 31 in addition to the tops of feet 23 engaging the tops of notches 35 as shown in FIG. 3, whereby the load is distributed between the flange and the side walls.

The basket and handle may be molded from a plastic such as impact styrene or other suitable material, and is assembled by deforming the slots 31 in the resilient side walls to insert the buttons 25 on the ends of the feet 23.

I claim:

1. In combination, a basket and a U-shaped handle straddling the basket which can be locked into a vertical position by lifting up on the handle and which automatically unlocks and rotates to a stowed position when released:

said basket having side walls forming an upper edge thereof and a rim extending laterally outward from the upper edge of each side wall and terminating in a downwardly directed flange spaced from and outside of each side wall, each of said flanges having a vertical notch extending upward into the flange from the downwardly directed free edge thereof, and said side walls of the basket each defining a closed-end vertical slot horizontally aligned with the vertical notch in the opposed flange, said U-shaped handle comprising two parallel legs depending from opposite ends of a hand grasping base portion, the free ends of the legs terminating in opposed, inwardly directed feet, each of which is provided with a neck portion spaced from the associated leg, said neck being slidably and rotatably received in the vertical slot in the side of the basket, and said slots being of such a length that with the necks of the feet on the handle located at the bottom of the slots the handle can be rotated between a generally horizontal and a vertical position and such that when the handle is lifted while in the vertical position, the sides of the feet engage the vertical notches in the flanges to prevent rotation of the handle.

2. The combination of claim 1 including wall members extending transversely between the flange and the side of the basket adjacent each side of each notch.

3. The combination of claim 1 wherein the notches and slots are so dimensioned vertically that the feet engage the tops of the notches and the necks engage the tops of the slots when the handle is lifted to distribute the load between these two contact points for each leg of the handle.

* * * * *